US008282443B2

(12) United States Patent
Vianello et al.

(10) Patent No.: US 8,282,443 B2
(45) Date of Patent: Oct. 9, 2012

(54) AUTOMATIC MACHINE FOR GRINDING THE PERIMETRIC EDGE OF GLASS SHEETS

(75) Inventors: Fortunato Vianello, Vallio di Roncade (IT); Dino Moschini, Roncade (IT)

(73) Assignee: For.El. Base di Vianello Fortunato & C. S.N.C., Vallio di Roncade (IT)

( * ) Notice: Subject to any disclaimer, the term of this patent is extended or adjusted under 35 U.S.C. 154(b) by 1057 days.

(21) Appl. No.: 12/232,407

(22) Filed: Sep. 17, 2008

(65) Prior Publication Data

US 2009/0081930 A1 Mar. 26, 2009

(30) Foreign Application Priority Data

Sep. 21, 2007 (IT) ..... TV2007A0162

(51) Int. Cl.
*B24B 7/06* (2006.01)

(52) U.S. Cl. ..... 451/178; 451/44; 451/388

(58) Field of Classification Search ..... 451/41, 451/43, 44, 178, 179, 182, 236, 241, 331, 451/388

See application file for complete search history.

(56) References Cited

U.S. PATENT DOCUMENTS

| | | | | |
|---|---|---|---|---|
| 2,579,337 | A * | 12/1951 | Reaser et al. | 451/239 |
| 4,656,791 | A * | 4/1987 | Herrington et al. | 451/38 |
| 6,910,953 | B2 * | 6/2005 | Allaire et al. | 451/44 |
| 2002/0068514 | A1 * | 6/2002 | Margaria | 451/44 |
| 2003/0181145 | A1 * | 9/2003 | Collins et al. | 451/41 |
| 2005/0020193 | A1 * | 1/2005 | Allaire et al. | 451/44 |

FOREIGN PATENT DOCUMENTS

| | | | |
|---|---|---|---|
| DE | 202 18 341 | U1 | 2/2003 |
| EP | 0 067 469 | A | 12/1982 |
| EP | 0 484 674 | A | 5/1992 |
| EP | 1 063 053 | A | 12/2000 |
| EP | 1 769 885 | A | 4/2007 |

* cited by examiner

*Primary Examiner* — Timothy V Eley
(74) *Attorney, Agent, or Firm* — Modiano & Associati; Albert Josif; Daniel O'Byrne

(57) ABSTRACT

An automatic machine and an automatic method for grinding the perimetric edge of rectangular or nonrectangular of glass sheets arranged substantially vertically, comprising at least one conveyor and at least one workhead provided with an abrasive tool for grinding the glass sheet at its edge, following its perimetric profile by way of the relative action of movement of the glass sheet and movement of the at least one workhead. During grinding, the glass sheet is no longer supported and moved by the conveyor but by at least one carriage, to which the glass sheet is coupled by way of at least one sucker.

10 Claims, 13 Drawing Sheets

AUTOMATIC MACHINE FOR GRINDING THE PERIMETRIC EDGE OF GLASS SHEETS

BACKGROUND OF THE INVENTION

Methods are currently known for grinding the unfinished edges of glass sheets as they are produced by cutting from the original production format to the actual use formats. In principle, grinding is applicable to any step of the machining of the glass sheet after cutting, for example before its use as is or as a necessary operation before tempering or as preparation of the glass sheet in order to obtain a uniform geometry and surface finish for particular uses, such as the composition of structural insulating glazing.

Grinding is performed for several reasons, which are listed here not in order of importance: the first reason relates to safety in handling the sheets, in which the edges would be dangerously sharp if they were not ground; the second one relates to the elimination of the edge defects of the sheets, typically so-called "microcracks", which might trigger breakages of the sheet in the subsequent working steps (particularly tempering) and in the subsequent state of use; the third one can be simply the definition of the format of the glass sheet with better dimensions, geometry and surface finish than can have been achieved with the first working step, i.e., cutting, which leaves the edges unfinished, and this is done for architectural uses, for use in interior decoration, and in particular for use in the composition of structural insulating glazing; additional reasons may be the most disparate.

In order to better understand the configuration of the glass sheet, not so much in its possible isolated use, but most of all in its more widespread use in combination with other components to constitute the so-called "double glazing unit" or, more technically, "insulating glazing", some concepts related to the intermediate component itself, i.e., the "glass sheet", and the final product, i.e., the "double glazing unit", are summarized hereinafter. The subsequent use of the double glazing unit, i.e., as a component of doors or windows or building faces, is known to the person skilled in the art and is not discussed here in detail.

With reference to FIG. 1A, the double glazing unit is constituted typically by two or more glass sheets 1001, 1002, which are mutually separated by one or more spacer frames 1003, which are hollow and have microperforations on the face directed toward the inside of the chamber.

The spacer frames 1003 usually contain, in their hollow part, hygroscopic material, which is not shown in the figure and is designed to absorb the moisture trapped during manufacture and/or any moisture that might subsequently penetrate due to seal defects. A chamber (or chambers) 1006 delimited by the glass sheets 1001 and 1002 and by the frame 1003 can contain air or gas or mixtures of gases injected therein, which provide the double glazing unit with particular properties, for example thermally insulating and/or soundproofing properties. The connection between the glass sheets and the frame is achieved by means of two levels of sealing: a first seal 1004 is designed to provide a hermetic closure and affects the lateral surfaces of the frame 1003 and the portions that are adjacent thereto of the glass sheets 1001, 1002; a second seal 1005 affects the compartment constituted by the outer surface of the frame and by the faces of the glass sheets up to the edge of such sheets and is designed to provide cohesion among the components and maintain the mechanical strength of the connection among them.

FIGS. 1A-1E show five possible sectional views of configurations of a double glazing unit, of which only the first one has been described above. However, it is straightforward to extend the comment provided above to the configurations shown in FIGS. 1B, 1C, 1D, 1E, related to examples of possible variations (double chamber, coated glass sheets, offset sheets, laminated sheets) and combinations of these variations. In the figure, the sun represents the outside environment of a building in which the double glazing units are installed, while the interior of the building is represented by a radiator.

The "glass sheets" used in the composition of the double glazing unit can have different shapes depending on their use; for example, the outer glass sheet 1001 (with respect to the building) can be normal or reflective (in order to limit heat input during summer months) or can also be laminated/armored (for intrusion/vandalism prevention functions) or can be laminated/tempered (for security functions) and can also be combined, for example reflective and laminated.

The inner glass sheet 1002 (with respect to the building) can be normal or of the low-emissivity type (in order to limit the dispersion of heat during winter months) or laminated/tempered (for security functions) or combined, for example low-emissivity and laminated.

In particular, FIGS. 1C, 1D, 1E illustrate an important category of insulating glazing, i.e., glazing also used with structural functions in addition to the particular functions of insulating glazing, i.e., the thermally and acoustically insulating functions. For this type of glazing, like the ones used in interior decoration, machining of the edge is necessary for correct definition of the dimensions, geometry and finish.

Currently it is known to perform this machining, which consists in grinding performed on the individual sheets, with a horizontal arrangement of the glass sheet on so-called two-sided machines or on so-called machining centers, or with a substantially vertical arrangement of the glass sheet on so-called beveling machines or on so-called arrissing machines.

In the first category, i.e., with a horizontal arrangement of the glass sheet, two-sided machines and machining centers, which are unexceptionable in terms of the results achieved in machining the edge of the glass sheet, machining centers in particular, by performing not only simple grinding but also contoured grinding in the perimeter and profiled grinding in the thickness (differently from beveling machines, which work only on rectangular glass sheets and provide only bevels in terms of profile), have the following problems: high costs and large space occupation.

In the second category, i.e., with a substantially vertical arrangement of the glass sheet, beveling machines, despite performing any profiled machining within the thickness of the edge, albeit only on straight sides, work only on one side at a time and are expensive, due to the large number of spindles, as well as slow in production; arrissing machines do not achieve the machining precision required for the uses cited earlier, since the reference of the machining of all four sides is always taken on the lower horizontal side, which is unfinished and irregular, i.e., as obtained by the cutting operation.

Further, with the exception of extremely expensive machining centers, all these machines can work only glass sheets of a rectangular format.

Respectively, Patent publications related to the background art cited above is as follows:

for the two-sided machine, EP1063053 B1, in the name of Z. Bavelloni S.p.A.;

for the machining center: EP0484674 B1, in the name of Intermac S.r.l.;

for beveling machines: EP0067469 B1, in the name of Elettromeccanica Luigi Bovone S.r.l.;

for arrissing machines: EP1769885 A1 in the name of this same Applicant.

None of these disclosures leads to the inventive advantages of the present application, which in summary consist in being able to perform, with a substantially vertical arrangement of the glass sheet, in a single machine and with an automatic feed, the working of the edge of the entire perimeter of the glass sheet, of any shape, without resting its lower edge on the conveyor.

EP1063053 B1, in addition to working on a sheet with a horizontal arrangement, in fact uses two machines and works only on rectangular sheets; EP0484674 B1, in addition to working on a sheet with a horizontal arrangement, requires complex manual positioning of the sheet; EP0067469 B1 performs work on a single rectilinear side of the sheet at a time; EP1769885 A1 keeps the glass sheet always rested on the conveyor.

SUMMARY OF THE INVENTION

The aim of the present invention is to solve the above-mentioned technical problems, eliminating all the drawbacks of the cited background art, by providing an automatic machine and an automatic method which allow to grind the perimetric edge of the glass sheets safely and cheaply, achieving a qualitative result which is superior to that of the background art or, for an equal qualitative result, using a machine and a method which are far cheaper despite being fully automatic.

Within this aim, an object of the present invention is to automate the grinding operation, eliminating operator interventions, including those for loading.

Another object is to not alter the structure of the production line of the insulating glazing, gaining an advantage from the modularity and verticality that typically characterizes it.

Another object is to increase productivity by reducing the working time.

This aim and these and other objects which will become better apparent hereinafter from the description that follows are achieved by an automatic machine and an automatic method for grinding the perimetric edge of substantially flat glass sheets arranged vertically, which comprises a machine body and at least one workhead, which is adapted to come into contact with the edges of a glass sheet, of any shape, and follow the entire perimeter thereof with a relative motion; said workhead comprising a tool which has a cutting motion which is adjustable substantially transversely to the plane of the glass sheet, and wherein the glass sheet is not resting at its edge but is retained on its face.

Advantageously, the glass sheet has a vertical arrangement, or rather, an arrangement which is slightly inclined with respect to the vertical, resting on a sliding plane, and can move horizontally on a conveyor until it arrives at the grinding tool and, before work starts, is raised with respect to the conveyor and entrusted, for support and translational motion, to carriages provided with suckers. The relative motion between the sheet and the tool is achieved by moving the sheet on a horizontal axis H and by moving the tool along a vertical axis V. This relative motion constitutes, in the jargon of machine tools, the so-called feed or advancement motion, while the tool is provided with a rotary motion which constitutes, in the jargon of machine tools, the so-called cutting motion and, again in the jargon of machine tools, with a registering motion along an axis T which is perpendicular to the face of the glass sheet 1.

The arrangement referenced as vertical is actually slightly inclined with respect to the vertical plane (generally by 6°) in order to give static stability to the glass sheet, i.e., prevent its tipping.

BRIEF DESCRIPTION OF THE DRAWINGS

Further characteristics and advantages of the invention will become better apparent from the following detailed description of a particular embodiment of the invention, illustrated by way of non-limiting example in the accompanying drawings, wherein.

DESCRIPTION OF THE PREFERRED EMBODIMENTS

Figure 1A:
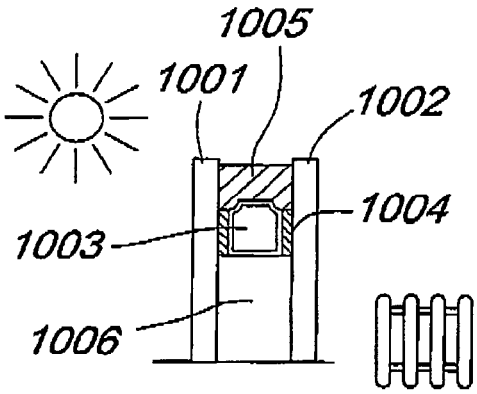
Fig. 1A PRIOR ART
FIGS. 1A-1E are partial sectional views of a series of typical double glazing unit configurations.
Figure 1B:
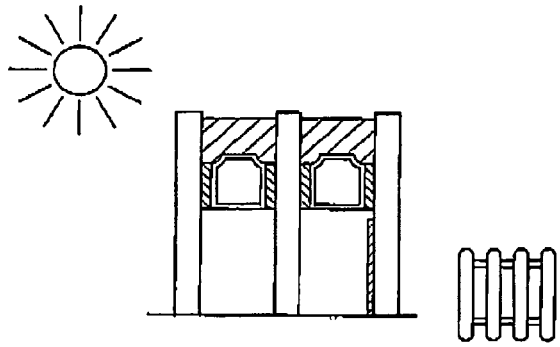
Fig. 1B PRIOR ART
Figure 1C:
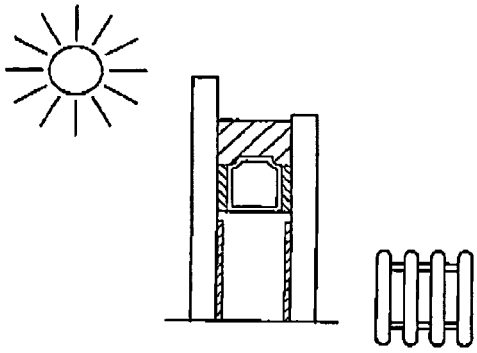
Fig. 1C PRIOR ART
Figure 1D:
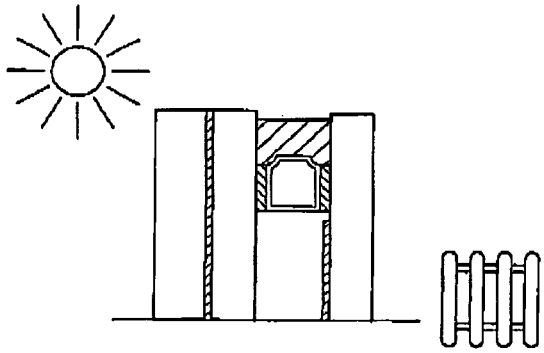
Fig. 1D PRIOR ART
Figure 1E:
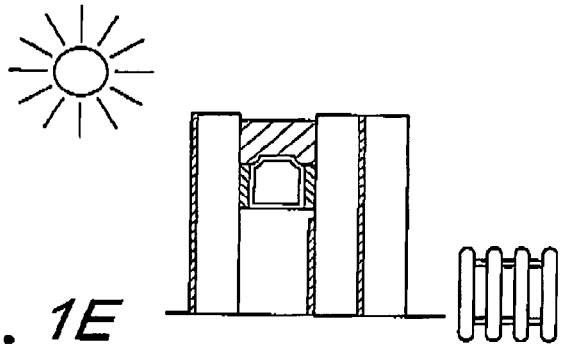
Fig. 1E PRIOR ART

As described earlier, FIGS. 1A-1E are schematic views of the peripheral portion of the double glazing unit according to an exemplifying series of possible constructional combinations: normal configuration (1A), triple glazing unit (1B), offset glass sheets (1C), laminated outer glass sheet and inner glass sheet of the low-emissivity type (1D), tempered reflective outer glass sheet and laminated inner glass sheet of the low-emissivity type (1E). The two types of sealant used in such constructions are: a butyl sealant 1004, which is intended to provide a seal (first seal) and is applied between the lateral surfaces of the frame and the glass sheets, and a polysulfide or polyurethane or silicone sealant 1005, which is intended to provide a mechanical resistance (second seal) and is applied between the outer surface of the frame and the inner faces of the glass sheets up to their edge.

From FIGS. 1A-1E and from what has been described hereinbefore, it can be deduced that the geometry of the insulating glazing designed for structural use must be precise in its dimensions, shape and finish. To achieve this, it is necessary to resort to grinding. The same applies to other types of glazing.

With reference to the figures, single-digit numerals (optionally combined with a letter for repetitive elements) designate the main assemblies of the machine, so as to have an overview thereof. The reference numeral 1 is reserved to the item being worked, i.e., to a glass sheet, while the details and constructive mechanisms are designated with three-digit numerals (optionally associated with a letter for repetitive components), in which the first digit is the digit of the main assembly to which they belong. The four-digit numerals designate the components of the double glazing unit and the machines that constitute the automatic line for the production of the double glazing unit (1000 designates a machine according to the present invention, 2000 designates an edging machine, 3000 designates a washing unit, 4000 designates a spacer frame applicator, 5000 designates a mating unit/press, 6000 designates a gas filler, 7000 designates a sealing machine).

Thus, the reference numeral 1 designates the single "glass" sheet, whose sides are designated respectively (in the case of a rectangular shape): the frontside 1*a*, the upper longitudinal side 1*b*, the lower longitudinal side 1*d*, and the rear side 1*c*. The adjectives "front" and "rear" in this case refer to the direction of motion of the glass in the machine.

The term "substantially" is intended to mean that the feature to which it refers has the configuration as defined by such feature (for example substantially flat) but for variations known to those skilled in the art as being within the tolerances which are normal in the technical field involved.

Figure 2:
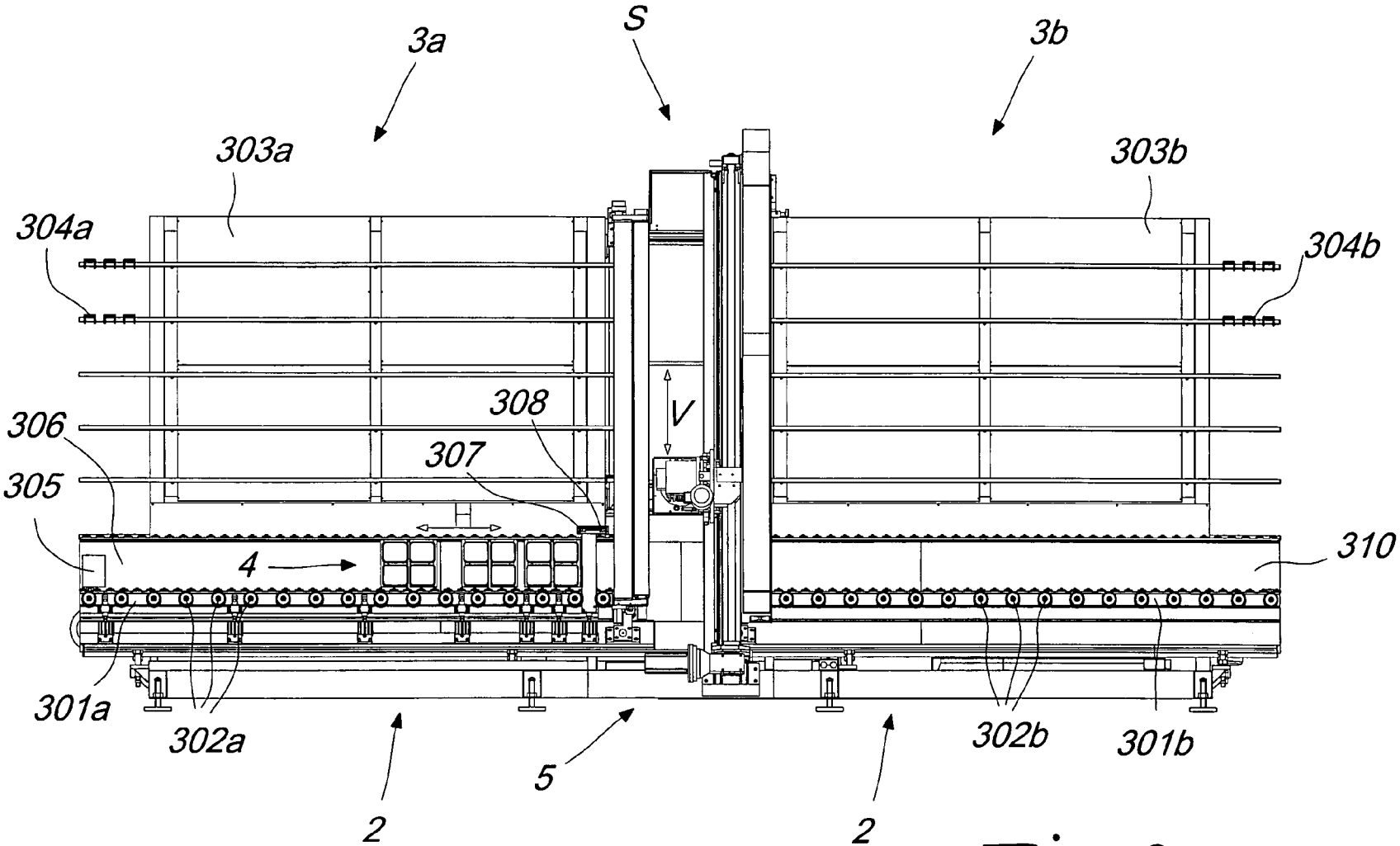
FIG. 2 is a general front view of the machine according to the invention.

With reference to FIG. 2, the machine according to the preferred embodiment comprises a main body 2 which has rollers for centering and retaining the glass sheet 1 connected in a cascade configuration between two conveyors 3*a* and 3*b*, which are arranged respectively upstream and downstream of the machine body 2. Together with the conveyor 3*a*, the sucker carriages 4 are provided, which perform a translational motion also in the section 3*b*. The machine body 2 comprises a carriage 5, which can move vertically on guides which are for example of the prism-shaped type, provided with the grinding workhead.

Figure 12F:
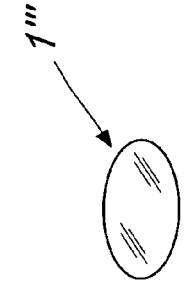
FIGS. 12C-12F show again, in plan view, examples of glass sheet shapes workable on the line including the machine according to the invention.
Figure 12E:
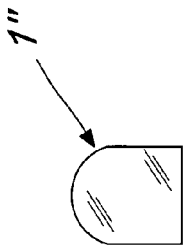
Figure 12D:
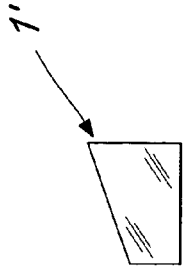
Figure 12C:
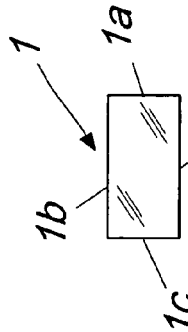
Figure 12A:
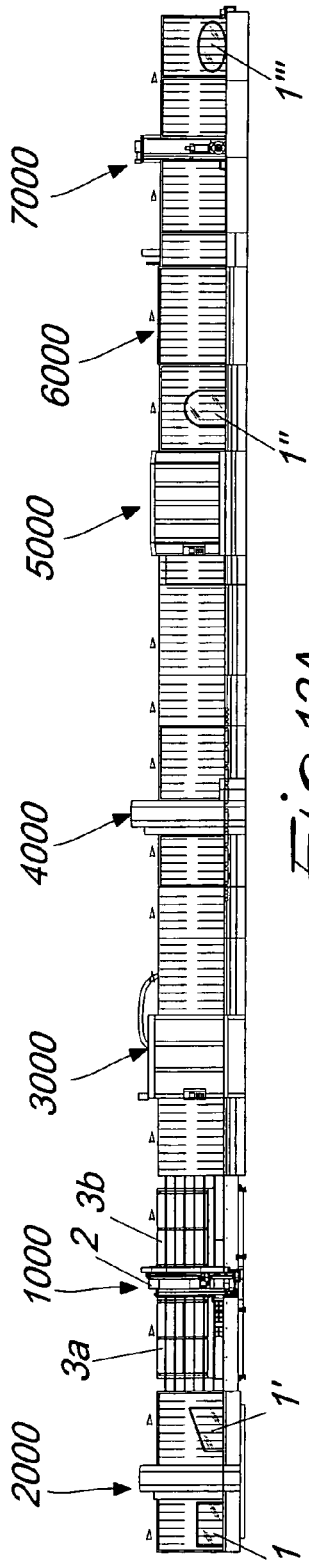
FIG. 12A is a view showing an example of the machine insertion according to the present invention, in the production line of an insulating glazing (in a front elevation view)
Figure 12B:
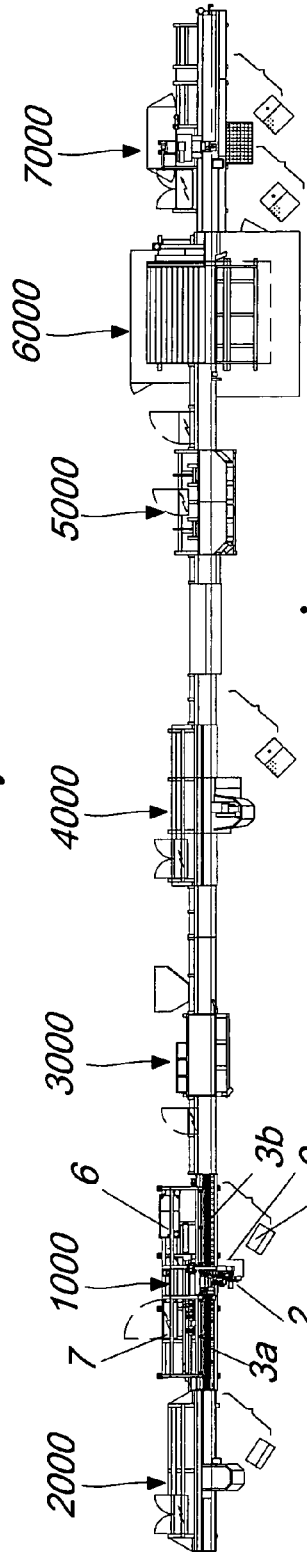
FIG. 12B is a view showing an example of the machine insertion according to the present invention, in the production line of an insulating glazing (in plan view)

A section 6, which is shown only schematically in FIG. 12B since it is known, comprises a hydraulic pump, which draws water from a recirculation reservoir, in order to direct a stream of water toward the cooling and lubrication nozzles of the tool. This circuit is of course provided with a filter, with valves and with other known accessories.

FIG. 12B includes the identifications of the main machine body 2, of the input and output conveyors 3*a* and 3*b*, of the water treatment system 6, of the electrical/electronic panel 7, of the control post 8, and of the safety devices 9.

Going back in greater detail to FIG. 2, the machine according to a preferred embodiment of the invention substantially comprises the grinding section S, which can move synchronously along the substantially vertical axis V, the input conveyor 3*a* (shown only schematically, since it is known) and the output conveyor 3*b* (shown only schematically, since it is known) being arranged respectively upstream and downstream of the section S, and also the section 4 provided with the sucker carriages, which can move synchronously along the horizontal axis H for the translational motion of the glass sheet 1. The input conveyor 3*a* can be connected to an upstream working section, for example the section for cutting the glass into sheets from the original format to the destination formats, or the edging machine or, as an alternative, the glass sheet 1 to be ground might also be loaded manually onto the conveyor 3*a* independently of the production line.

Figures 8A, 8B:
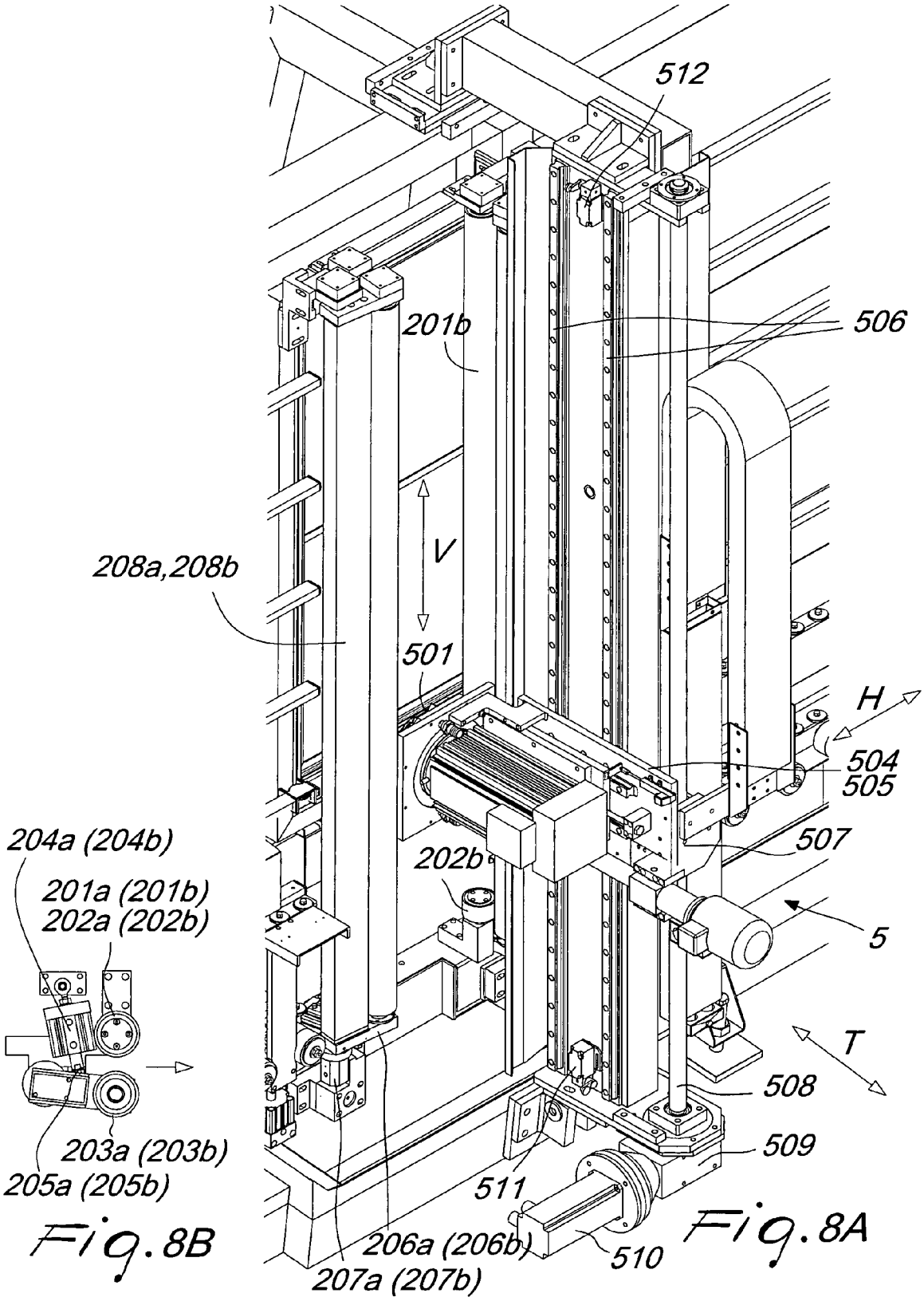
FIGS. 8A, 8B are a perspective view of the part of the machine that performs the synchronous motion of the machine tool body along the vertical axis V and of the system for retaining the glass sheet during grinding, and of a detail thereof, respectively.

The output conveyor 3*b* instead can be connected to a downstream working section, for example the section where the manufacture of the double glazing unit begins, particularly the washing unit. Both conveyors, like the central machine body, keep the sheet at an inclination of approximately 6° with respect to the vertical, as shown in FIG. 8A.

The input conveyor 3*a* comprises a roller bed 301*a* for supporting the lower edge of the glass sheet, on which a plurality of motorized supporting and conveyance rollers 302*a* are provided. The conveyor further comprises a resting surface 303*a*, on which the glass sheet is rested substantially vertically, i.e. vertically or slightly inclined at an angle, with respect to the vertical, that is in the order of few hexagesimal degrees (for example less than 10°, preferably less than 7°) provided with free rollers 304*a*.

The conveyors are widely known and therefore are not discussed here in detail. It is therefore straightforward to understand that the output conveyor 3*b* is substantially similar to the input conveyor.

Figure 6:
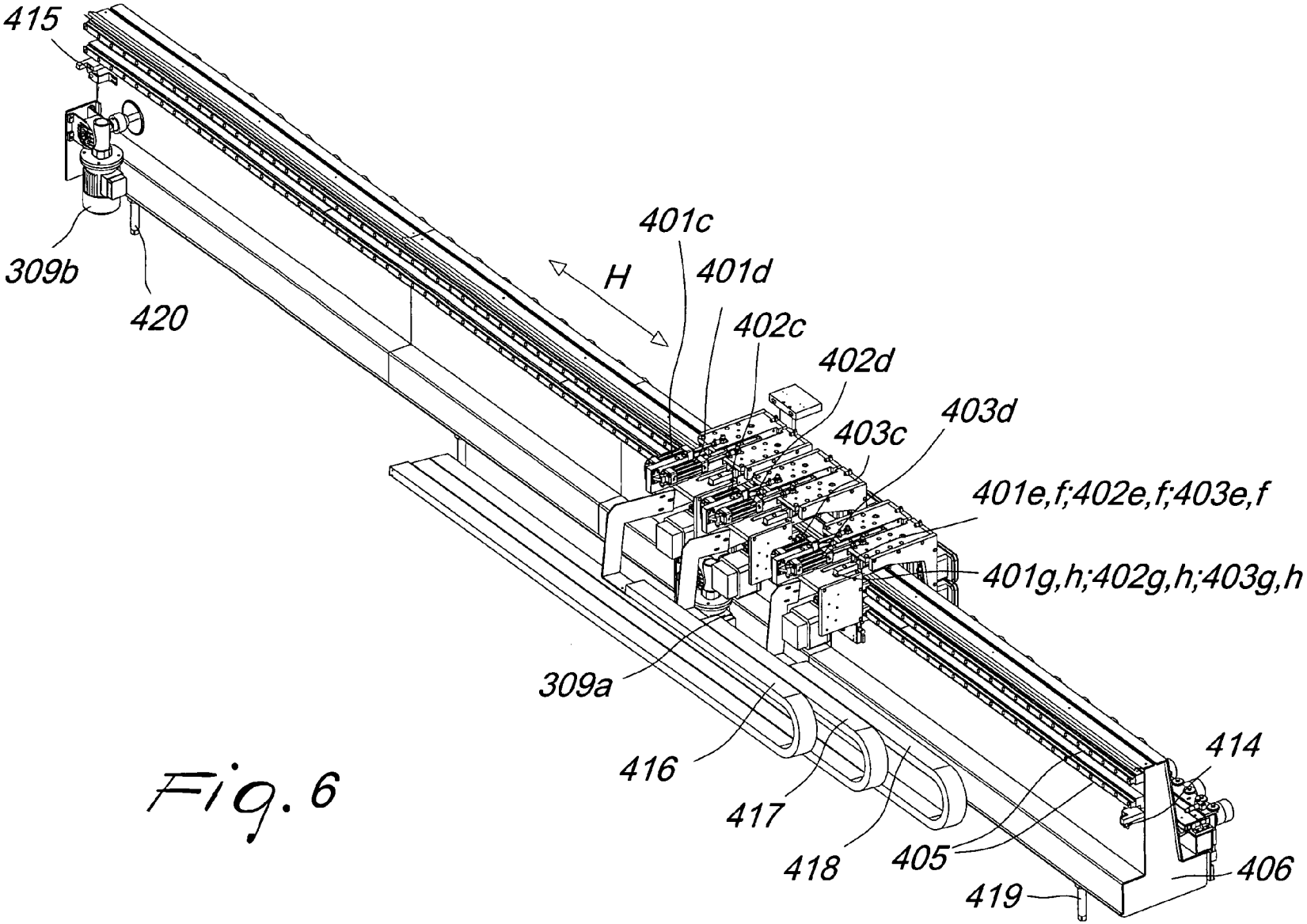
FIG. 6 is a rear perspective view of the part of the machine that moves the conveyor for the translational motion of the glass sheet when inactive and of the part of a machine that performs the synchronous movement of the sucker carriages along the horizontal axis H.

The input conveyor 3*a* comprises a known type of thickness detector 305 for measuring the thickness of the glass sheet to be worked before it enters the grinding section S, this information being necessary in order to provide a signal for centering the abrasive tool if it is simply cylindrical, in this case to distribute the wear over the entire cylindrical band, and in particular if it is contoured, in order to mate complementarily with the edge of the glass sheet 1. The input conveyor 3*a* also comprises a sensor 306 for detecting the presence of the glass sheet in the loading region and two sensors 307, 308, respectively for actuating the slowing and stopping of the glass sheet proximate to the grinding section S by means of a motor 309*a* (shown in FIG. 6) and the transmission mechanism of the known type. Moreover, the output conveyor comprises a sensor 310 for stopping the glass sheet 1 at the end of the machine or for clearance for the downstream machines that must perform the subsequent work described in the introduction on the glass sheet.

Figure 3:
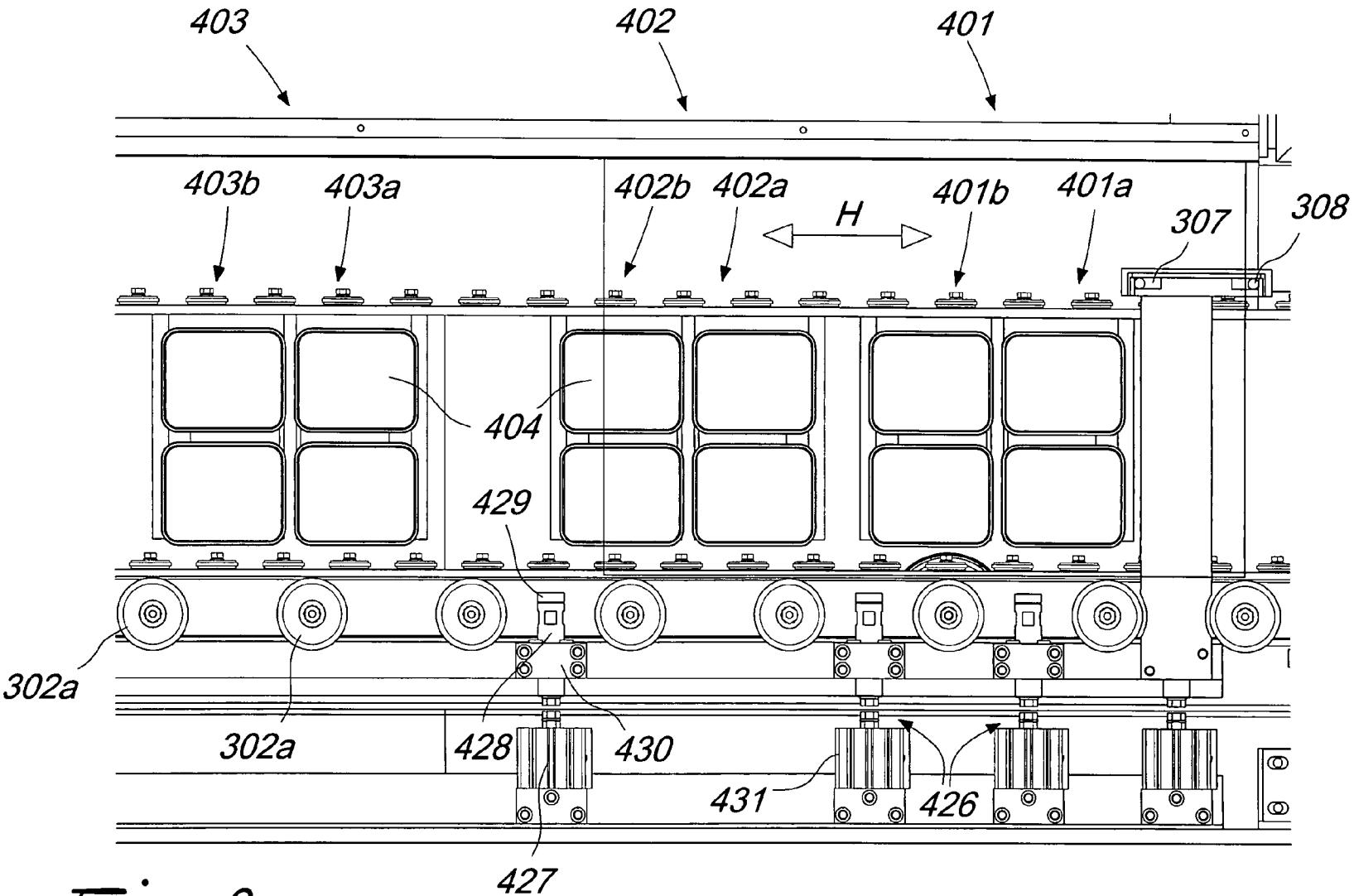
FIG. 3 is a view of the conveyor in the condition in which the glass sheet 1 rests thereon.
Figure 4:
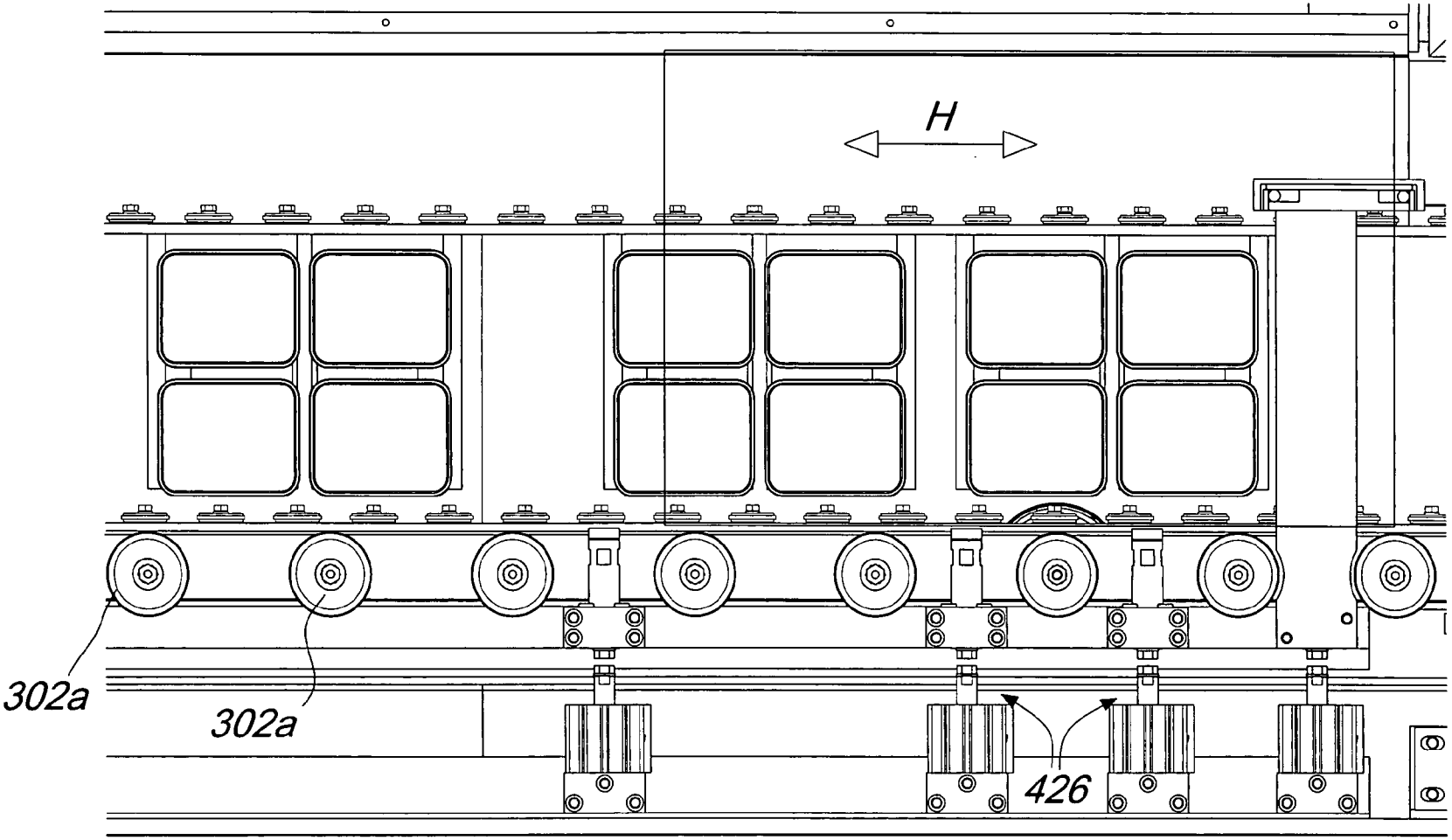
FIG. 4 is a view of the conveyor in the condition in which the glass sheet is raised by means of the leveling units for leveling before assignment to the sucker carriages.
Figure 5:
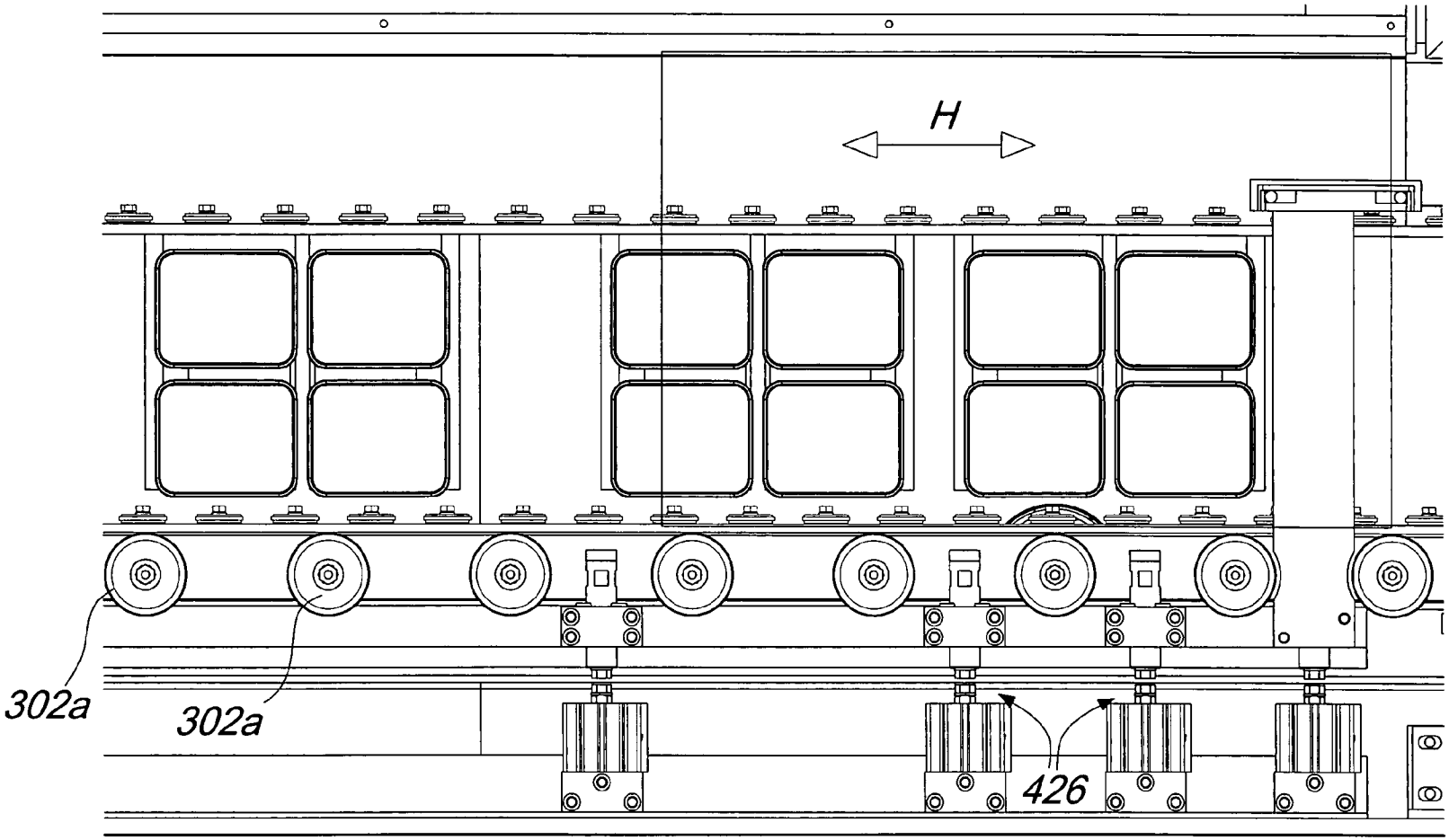
FIG. 5 is a view of the condition in which the conveyor is disabled, the glass sheet is assigned to the sucker trucks and the leveling units are inactive.
Figure 7:
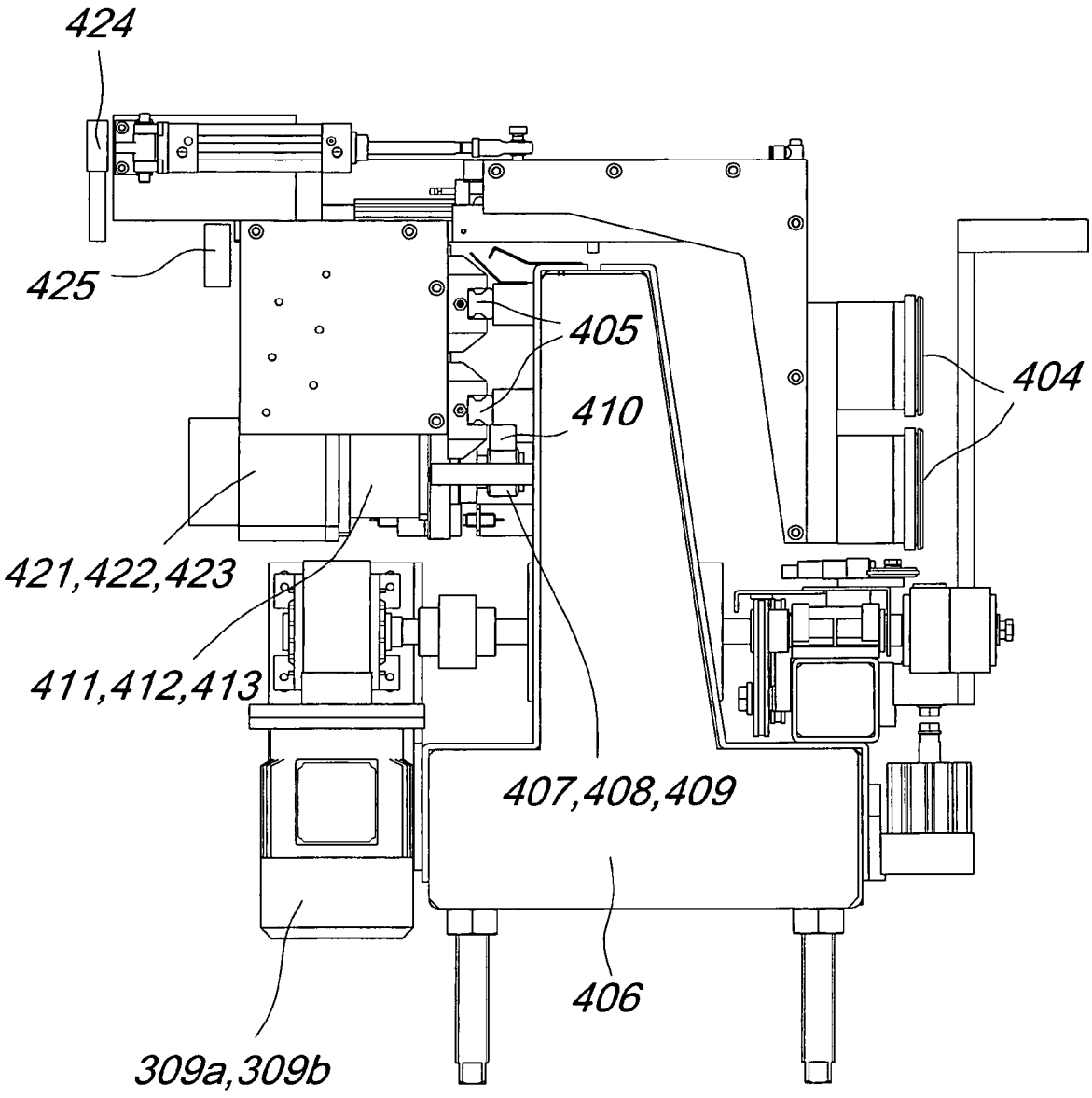
FIG. 7 is a side view of some components of FIG. 6, particularly the ones hidden in FIG. 6.

Three sucker carriages 401, 402, 403 (shown in detail in FIGS. 3, 4, 5) are superimposed on the conveyors, have a motion which is actuated independently of the motion of the roller conveyors 302*a*, 302*b* and independently with respect to each other, and are dedicated to the synchronous traction of the glass sheet 1 along the axis H; each carriage comprises two trucks 401*a*, 401*b*, 402*a*, 402*b*, 403*a*, 403*b*, and each truck can move transversely with respect to the face of the glass sheet 1; each truck is provided with two suckers such as the suckers 404. All three carriages can move on the same guides 405, which are coupled to a beam 406 (shown in FIGS. 6 and 7) which runs along the conveyors 3*a* and 3*b* and the machine body 2 and are engaged by means of respective pinions 407, 408, 409 on a same rack 410 which is coupled to the same beam 406. Respectively, the three carriages are moved as follows: the carriage 401 by a reduction unit 411, the carriage 402 by a reduction unit 412, the carriage 403 by a reduction unit 413 and by corresponding motors 421, 422 and 423.

Auxiliary parts are constituted by stroke limit sensors 414 and 415 (together with other similar ones which interact between the carriages), by cable guiding channels 416, 417, 418 for accommodating and leading respectively to each carriage (since each one can move independently of the others)

the power and signal circuits; conveniently, the beam 406 is adjustable at least in the points 419 and 420 (shown in FIG. 6, together with others which are distributed along the length of the beam 406) for its correct arrangement, which must be absolutely perpendicular to the guides that form the vertical axis V described hereafter (as an alternative or additionally, said registration can be entrusted to the components of the section S).

The plurality of the sucker carriages is useful in order to adapt the dimensions of the glass sheets 1, which can be the most disparate. The movement of the trucks 401*a*, 401*b*, 402*a*, 402*b*, 403*a*, 403*b* toward the rear face is achieved by way of the action respectively of the pneumatic cylinders 401*c*, 401*d*, 402*c*, 402*d*, 403*c*, 403*d*, which actuate the trucks 401*a*, 401*b*, 402*a*, 402*b*, 403*a*, 403*b*, the ball-bearing sliders 401*e*, 401*f*, 402*e*, 402*f*, 403*e*, 403*f* of which can move on respective guides 401*g*, 401*h*, 402*g*, 402*h*, 403*g*, 403*h*. The various suckers, generally designated by the reference numeral 404, are placed in partial vacuum by means of the ejectors 424 and the status of the partial vacuum is controlled by the pneumatic/electric transducers 425, since the grinding cycle, in view of the considerable forces involved, the speed of the tool and the fragility of the glass sheet, must be allowed only when the glass sheet 1 is firmly retained, and accordingly must be interrupted if the minimum degree of vacuum required to ensure safe grip of the sheet is not available.

The section 4 also includes a series of pushers 426 (designated by reference numerals in FIGS. 3, 4, 5), which, coupled to the beam 406, lift the glass sheet 1 by interaction with the edge of its lower side 1*d* (FIGS. 11A-11D) so as to disengage said edge from contact with the supporting and conveyance rollers 302*a*. This is achieved by means of pneumatic cylinders 427, as an extension of whose stem a cylindrical pin 428 with a flat head made of resilient material 429 moves, being guided by a bush 430. Suitable sensors 431 detect the upper stroke limit position. The series of pushers is constituted by a number of units which is consistent with the minimum and maximum dimensions of the glass sheets 1 to be worked, but only two of them rise in almost extreme positions of the lower side 1*d* of the sheet so as to provide stable support to said side; information regarding the length of the base of the glass sheet originates from the series of inputs received via a keyboard, FD, net, scanner, et cetera and processed by the process logic system, which selects which pushers are to be lifted.

Figure 9:
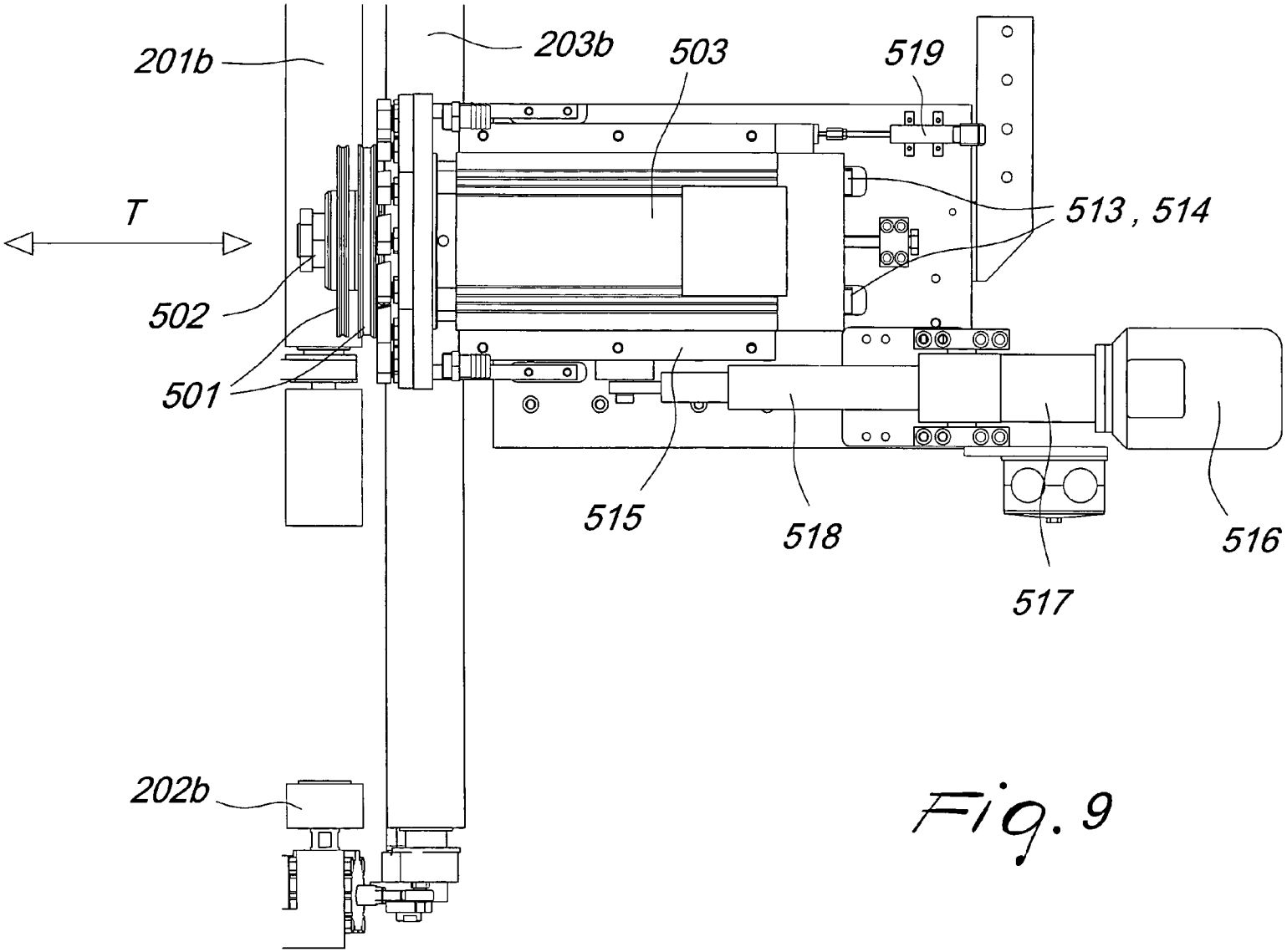
FIG. 9 is a plan view of the part of machine that performs the registration movement of the tool along the axis T at right angles to the face of the glass sheet 1.

The grinding section S comprises the free rollers for coupling the glass sheet 1 transversely to the resting surfaces 303*a* and 303*b* and therefore to said glass sheet, such as 201*a*, 202*a* and 201*b*, 202*b*, which are shown in FIGS. 8A, 8B and 9, together with the mutually opposite rollers such as 203*a* and 203*b*, which are adjustable transversely against the face of the glass sheet 1 that is directed toward the operator, by means of the actuator cylinders 204*a*, 204*b*. A compartment for the transit of the sucker carriages 401, 402, 403 is provided between the rear rollers 201*a* and 202*a* and between the rear rollers 201*b* and 202*b*. These cylinders actuate the positions of the free rollers respectively for opening and closing toward the glass sheet 1 by means of mechanisms constituted by the pivots 205*a*, 205*b*, which belong to the levers 206*a*, 206*b*, which are pivoted to the bearings 207*a*, 207*b*; the torsion bars 208*a*, 208*b* transfer the action of these cylinders along the entire vertical extension, keeping the front free rollers (the reference is with respect to the glass sheet) parallel to the front face of the sheet 1.

The grinding section S comprises mainly the section 5, which provides the synchronous vertical motion along the vertical axis V of the workhead 5 comprising the tool 501 which is fitted on a spindle 502, which has a cutting motion by way of the action of the motor 503, and its registration along the axis T at right angles to the face of the glass sheet 1. To achieve the first movement, a slider 504, provided with ball bearing sliders 505 (hidden but noticeable in FIG. 8A) which can slide on guides 506, is moved vertically through a ballscrew 507 (which is hidden but noticeable in FIG. 8A), which interacts with a screw 508 actuated by a reduction unit 509 and by a synchronous motor 510. Stroke limit microswitches 511 and 512 stop the stroke of the slider 504 in case of anomalies of the control system. To obtain the second movement, the slider 504 in turn is provided with guides 513 which are arranged at right angles to the face of the glass sheet 1, on which a slide 515 can move by means of ball bearing sliders 514 (which are hidden but noticeable in FIG. 8A) by way of the action of a motor 516 by means of a reduction unit 517 on a screw/ballscrew assembly 518. The position of said transverse slide with respect to the face of the glass sheet 1 is determined by the signal of a potentiometer 519, which is sent to the process logic control system.

Figure 11A:
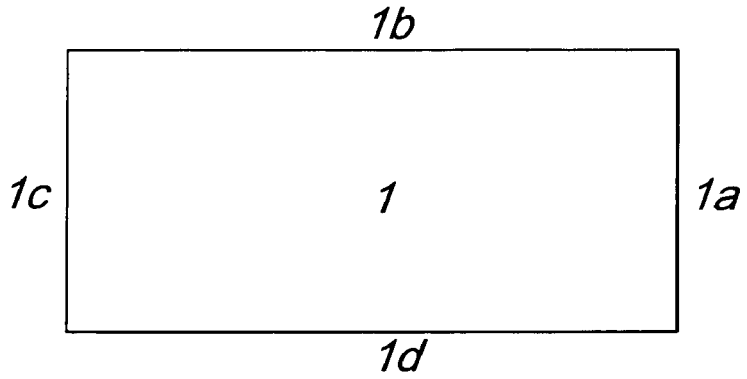
FIGS. 11A-11J are views of the plan shapes of the glass sheets that can be worked with the machine and the method according to the present invention and of possible respective configurations of the edge after said work.
Figure 11B:
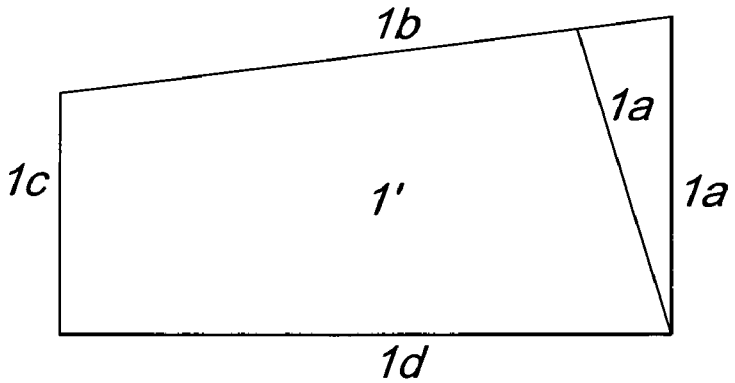
Figure 11C:
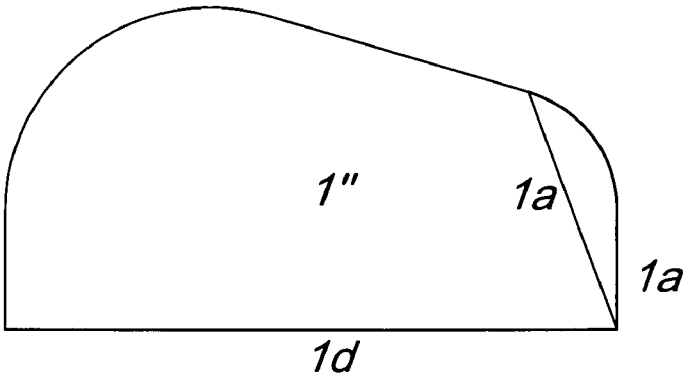
Figure 11D:
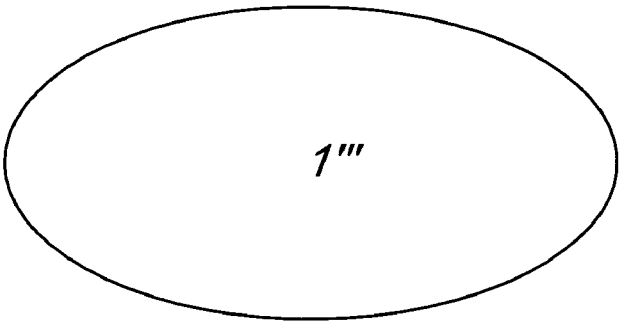

Having completed the description of the mechanisms that constitute the machine, the process for grinding the glass sheet 1 is now described (optionally complementing the numbering for completeness also of the corresponding description of the machine cited earlier, where necessary), beginning with the rectangular type of FIG. 11A.

The glass sheet 1 that arrives from the preceding working machine such as the machine 2000 (or loaded manually or by means of a loading unit onto the input conveyor 3*a* of the machine) is made to advance, conveyed by the support and conveyance rollers 302*a* of said conveyor and resting on the series of rollers 304*a*, until it stops at the sensor 308, after a slowing activated by the sensor 307.

In this condition, the pushers 426 intervene and lift the sheet, separating it from the rollers 302*a* and placing its base, oriented along the axis H, perfectly at right angles to the axis V of the section S. The reaching of this condition, which is verified by the sensors 431, thus provides clearance for the positioning of the sucker carriages along the axis H, which are arranged by distributing themselves according to the dimensions of the glass sheet 1; the information needed to perform this positioning correctly is derived from the process logic system, which knows the dimensions and shape of the unfinished glass sheet 1 as an input data item, together with the input data item of the finished dimensions required once grinding has been performed (all these inputs, both the ones referred to the unfinished dimensions and those referred to the finished dimensions, are acquired by means of a keyboard, FD, net, scanner, et cetera). Once all or some of the sucker carriages 401, 402, 403 are positioned and all or some sucker trucks 401*a*, 401*b*, 402*a*, 402*b*, 403*a*, 403*b* are fully located at the glass sheet 1, they are moved closer by means of the action of the pneumatic cylinders 401*c*, 401*d*, 402*c*, 402*d*, 403*c*, 403*d*, and the corresponding ejectors 424 are activated to couple the corresponding suckers to the glass sheet 1.

The glass sheet 1 is then conveyed synchronously (by means of the motors involved of the series 421, 422, 423) to the section S in a position for deliberate interference between the vertical side 1*a* and the tool 501 according to the corresponding input (acquired by means of a keyboard, FD, net, scanner, et cetera), which corresponds to the portion of the unfinished edge of the glass sheet 1 that is to be worked mechanically in order to define the geometry and finish of the edge of the glass sheet 1 of the finished conditions.

In this position of the glass sheet 1, the tool 501, which is in the lowered position but centered along the axis T with respect to the thickness of the glass sheet 1 by way of the mechanisms 513, 514, 515, 516, 517, 518, 519, is turned by means of the asynchronous motor 503, which is driven by an inverter to select the cutting speed suitable for the material being worked, and begins its stroke along the vertical axis V by means of the synchronous motor 510 to work the side 1*a*. Once the stroke along the vertical axis V that corresponds to the measurement to be obtained for the side 1*a* (FIGS. 11A-11D), plus the overtravel equal to half the diameter of the tool 501, has been completed, the vertical motion V of the tool 501 is interrupted and the horizontal motion H of the glass sheet begins by way of the action of the motors 421, 422, 423 whose carriages 401, 402, 403 have one or more trucks 401*a*, 401*b*, 402*a*, 402*b*, 403*a*, 403*b* coupled to the glass sheet 1, until working of the side 1*b* is completed. Using the same logic, the rest of the perimeter is traced to work the sides 1*c* and 1*d*.

With reference to FIG. 11A, the succession of the working of the sides can follow other criteria, for example the criterion of clearing as soon as possible the input conveyor 3*a*, in which case this succession becomes 1*d*, 1*a*, 1*b*, 1*c* and the glass sheet is entirely moved onto the conveyor 3*b* before the working of its lower side 1*d* begins. Again with reference to FIG. 1A, in order to optimize the cycle, the tool 501 can remain with its peripheral part always in contact with the edge of the glass sheet, and this is achieved by interpolating the action of the motors 510 and 421 (422, 423) by combining the motions along the axis V of the tool 501 and along the axis H of the glass sheet 1, as would occur for the cases of the options described hereinafter for glass sheets having nonrectangular shapes.

Control of the position of the glass sheet 1 and of the tool 501 in the particular case in which the glass sheets to be worked are shaped differently from a rectangle is important for coordination of the simultaneous horizontal movement H of the glass sheet and vertical movement V of the tool 501, which is required to ensure that the grinding tool is always mated with the perimeter of the glass sheet 1 in the final dimensional condition.

Advantageously, and necessarily for glass sheets 1 which are nonrectangular (for example, with reference to FIGS. 11B-11D, 1', which is contoured with portions which are all rectilinear; 1", which is contoured with part of its portions which are curved; and 1''', which is contoured with portions which are all curvilinear) but also optionally for glass sheets 1 which have a rectangular shape, this is achieved with known numeric control systems or with the axial interpolations that are possible with PLCs (programmable logic controllers).

The possible options are as follows:

OPTION 1: working a rectangular glass sheet 1 (to maintain contact proximate to the corners, i.e., at the intersections of the sides)

OPTION 2: working a glass sheet 1' with a rectilinear contour;

OPTION 3: working a glass sheet 1" with a curvilinear contour;

OPTION 4: working a glass sheet 1''' with a curvilinear contour.

All the descriptions resume from the position, already described, in which the glass sheet 1, 1', 1") stops at the stop sensor 308. For the case in which the first side 1*a* of the glass sheet 1 is not vertical (a case which is possible for the embodiments 1' and 1" and always occurs for the shapes 1''', see the dashed lines in FIGS. 11B and 11C), stopping in the work start position is not determined by the sensor 308 but by software, which on the basis of the shape of the glass sheet 1', 1" or 1''' interacts directly with the motor that actuates the axis H.

OPTION 1: this option was already described earlier.

OPTION 2: everything proceeds as in the description of option 1, except that in order to follow the inclination of some sides, for example 1*a* or 1*b*, which are not vertical or not horizontal, the axes H and V work by being interpolated by means of the concatenated actuation of the motors 421 (422, 423) and 510. The lower side, which for these shapes must be horizontal to allow transfer on the conveyors 3*a* and 3*b*, is instead worked by the tool 501, while the glass sheet 1' moves along the horizontal axis H by way of the action of the motor 421 (422, 423) while the vertical axis V is not active (motor 510 not running).

OPTION 3: everything proceeds as in the description of option 1, except that in order to follow the inclination of some sides, for example the side 1*a* which is not vertical, and the curvilinear shape of some other sides, the axes H and V work by being interpolated by means of the concatenated actuation of the motors 421 (422, 423) and 510. The lower side, which for these shapes must be horizontal to allow transfer onto the conveyors 3*a* and 3*b*, is instead worked by the tool 501 while the glass sheet 1' moves along the horizontal axis H by way of the action of the motor 421 (422, 423) while the vertical axis V is not active (motor 510 not running).

OPTION 4: for this option, the axes H and V always work by being interpolated by means of the concatenated actuation of the motors 421 (422, 423) and 510 and the glass sheet 1 is supported and conveyed exclusively by at least one of the suckers such as the sucker 404.

Figure 11E:
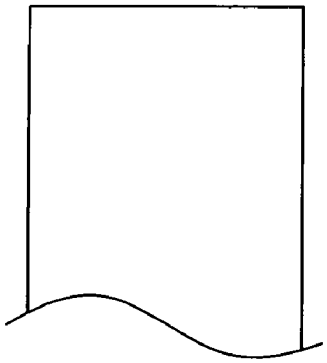
Figure 11F:
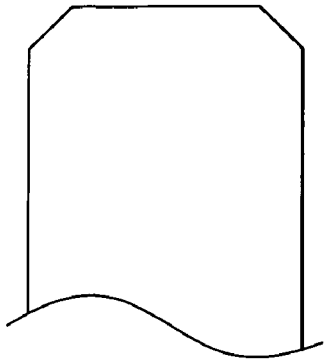
Figure 11G:
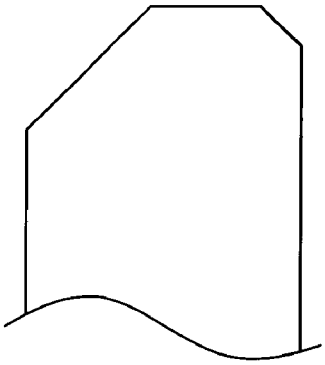
Figure 11H:
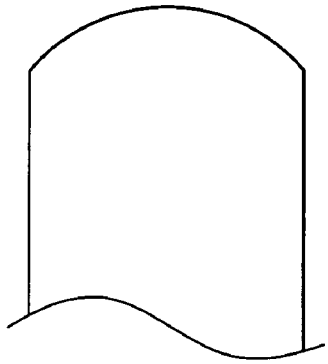
Figure 11I:
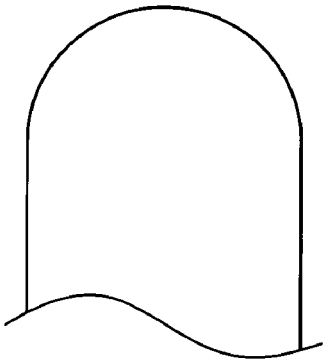
Figure 11J:
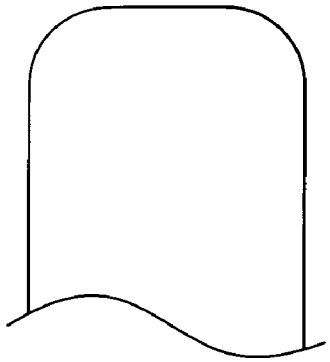

For all the options, grinding converts the edge of the glass sheets from unfinished, as obtained by the cutting operations, to finished in terms of shape, dimensions and finish, and profiled in terms of thickness according to FIG. 11E, which has an exemplifying but not exhaustive function.

Figures 10A, 10B, 10C, 10D:
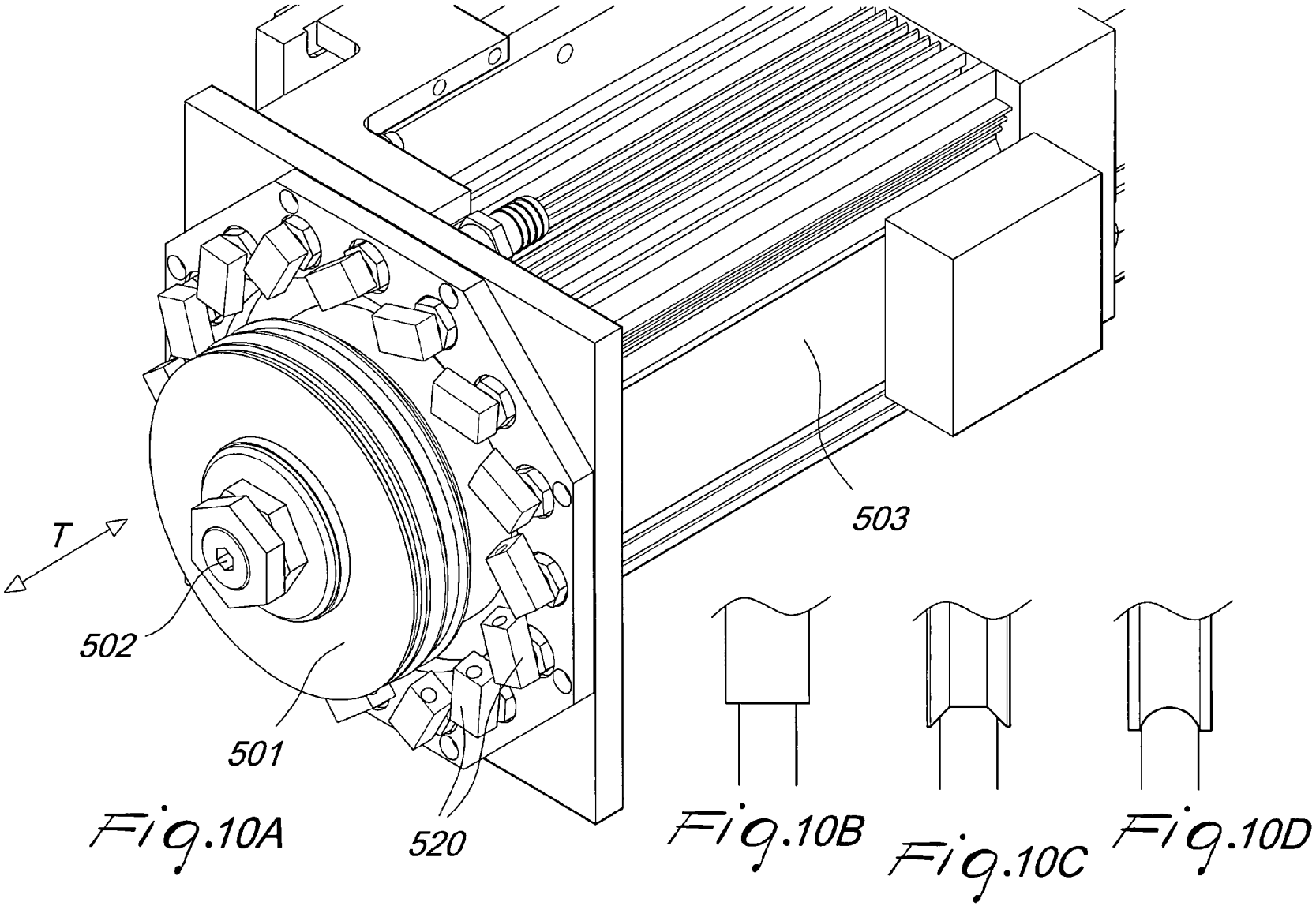
FIGS. 10A-10D are views of the tool cooling/lubrication system and of some forms of tool, respectively.

Conveniently, the tool 501 is wet by a refrigerating/lubricating stream by means of a plurality of nozzles 520 as arranged in FIG. 10A. The same figure shows in the installed condition a profiled tool 501 and shows examples of cross-sections of some other possible profiled tools.

The descriptions given above refer to grinders in which the source machine (for example the edging machine 2000) is arranged on the left and the destination machine (for example the washing unit 3000) is arranged to the right of said machine according to the present invention; it is easy to imagine the description and the corresponding figures in the case of mirror-symmetrical or otherwise different arrangements.

Of course, all the movements connected to the steps of the cycle are mutually interlocked with the aid of a parallel logic system which is always active, in order to avoid, during the process, conditions of interference between actuators, tools and material being worked.

It goes without saying that the industrial application is assuredly successful, since in many applications the perimetric edge of the glass sheet must be worked and machines for grinding the perimetric edge of glass are already very widespread in different types, each of which solves some requirements but neglects others. Moreover, the double glazing unit market is continuously expanding, since in recent years it has been increased by all the configurations that require the use of special glazing, such as the ones described in the introduction (and in particular glazing worked on the perimetric edge so as to achieve shape and dimensional precision and the finish as required for use in structural glazing).

The grinding of the perimetric edge of the glass sheet is a very important added value which qualifies the product, especially if the work is performed with machines and methods that are cheaper than those currently commercially available.

Moreover, the spread of shapes that are not rectangular because they are polygonal or curvilinear or mixed, further increases the value of the present invention, in contrast with the limitation of many widespread machines which can work only rectangular shapes.

Moreover, a sector that is developing daily and also requires grinding of the perimetric edge of the glass sheets 1 is constituted by all applications that require the use of tempered glass, such as interior decoration or electrical household appliances.

Moreover, the considerable space occupation of machines for working the perimetric edge of glass sheets that work with the glass sheet 1 arranged horizontally leads to the development of the machine according to the present invention, which is much more compact.

It has thus been shown that the machine and the method according to the invention achieve the intended aim and objects. The invention is susceptible of numerous modifications and variations, all of which are within the scope of the appended claims. Thus, for example, the mechanical solutions for the motions for feeding the tool, supporting and moving the glass sheet and the actuation means, which can be electrical, electrical-electronic, pneumatic, hydraulic and/or combined, while the control means can be electronic or fluidic and/or combined. In particular, an important variation can be the assignment of both motions, along the axis H and along the axis V, to the section S, keeping the glass sheet 1 stationary.

Moreover, the tool 501 can have a profiled shape (which is complementary to the profile that one wishes to obtain on the edge of the glass sheet) of any kind.

Of course, the spindle 502 can be fitted, for this purpose, with interchangeable tools 501, or the tool 501 can have multiple profiles, each selectable by means of a simple axial registration motion along the axis T, or several tools 501 can be installed on the same spindle 502 and used alternatively with a simple axial registration motion along the axis T. This can be important not only for performing work with grinders that have different profiles but also different mixes and grains in order to obtain different or progressive finishes.

The constructive details can be replaced with other technically equivalent ones. The materials and dimensions may change according to requirements, particularly arising from the dimensions (base, height, thickness) of the glass sheets 1.

The disclosures in Italian Patent Application No. TV2007A000162 from which this application claims priority are incorporated herein by reference.

What is claimed is:

1. An automatic machine for grinding a perimetric edge of a substantially flat glass sheet arranged substantially vertically, comprising:

a machine body;

at least one conveyor;

at least one sucker carriage which is movable with a synchronous horizontal motion along a horizontal axis; and at least one workhead, which is movable with a synchronous vertical motion along a vertical axis, said workhead being provided with a tool which has a rotary cutting motion and which is movable with a registering motion along an axis which is perpendicular to a face of the glass sheet to be ground, said tool being adapted to come into contact with an edge of the glass sheet and being able to move with respect to the glass sheet along an entire perimeter thereof, said at least one conveyor being located so as not to provide edge support for the glass sheet during grinding.

2. The machine of claim 1, further comprising suckers suitable to interact with one face of the glass sheet for providing support for the glass sheet during edge grinding thereof.

3. The machine of claim 2, wherein said suckers are connected to said at least one sucker carriage which is movable on guides of the machine to produce synchronous movement of the glass sheet along said horizontal axis.

4. The machine of claim 3, further comprising pushers which interact with an edge of a lower side of the glass sheet for lifting and leveling the lower side of the glass sheet in order to separate the glass sheet from said at least one conveyor.

5. The machine of claim 4, wherein said tool of said workhead is selected from a single diamond grinding wheel with a multiple profile and a set of profiled and cylindrical grinding wheels.

6. The machine of claim 5, wherein the grinding wheels each comprise a mutually different abrasive mix and grain.

7. The machine of claim 2, wherein motions along said horizontal axis and along said vertical axis are performable by said tool while the glass sheet is retained in a fixed position by way of said suckers.

8. The machine of claim 1, wherein said tool of said workhead is a cylindrical diamond grinding wheel.

9. The machine of claim 1, wherein said tool of said workhead is a profiled diamond grinding wheel.

10. The machine of claim 1, having a substantially vertical lying plane, so as to allow insertion of the machine in a line for working glass sheets arranged with an arrangement which is substantially vertical.

* * * * *